US005086718A

United States Patent [19]

Ogawa

[11] Patent Number: 5,086,718

[45] Date of Patent: Feb. 11, 1992

[54] SEWING MACHINE WITH AUTOMATIC THREAD TAKE-UP AND THREADING

[75] Inventor: Masao Ogawa, Nagoya, Japan

[73] Assignee: Brother Kogyo Kabushiki Kaisha, Aichi, Japan

[21] Appl. No.: 592,831

[22] Filed: Oct. 4, 1990

[30] Foreign Application Priority Data

Oct. 9, 1989 [JP] Japan ..... 1-263609

[51] Int. Cl.[5] ..... D05B 87/02

[52] U.S. Cl. ..... 112/225; 112/243

[58] Field of Search ..... 112/224, 225, 302, 241, 112/242, 243; 223/99

[56] References Cited

U.S. PATENT DOCUMENTS 4,355,591 10/1982 Itoh et al. ..... 112/225
4,461,409 7/1984 Biemans ..... 223/9
4,893,573 1/1990 Moriya ..... 112/225

FOREIGN PATENT DOCUMENTS 0063228 1/1988 Japan .
11-113092 5/1989 Japan .

*Primary Examiner*—Peter Nerbun
*Attorney, Agent, or Firm*—Oliff & Berridge

[57] ABSTRACT

A sewing machine for automatic thread take-up and threading, which comprises a guide groove for guiding a needle thread from a bobbin to a threading preparatory position via a thread take-up preparatory position, a sewing machine motor driver and a sewing machine motor for extracting the needle thread at the thread take-up preparatory position along the thread take-up moving area and for taking up the needle thread using a thread receiver and/or a thread take-up, and a thread positioning member for keeping the end of the needle thread guided to the threading preparatory position and for positioning the needle thread in front of or at the rear of the eye of a needle, a threading member for performing the threading operation of the needle thread, and a prohibiting member for prohibiting the threading operation until the thread take-up operation is over. In the sewing machine, the thread take-up operation and the heading operation are automatically and successively performed. The needle thread is kept at its end by a thread positioning member and a tension member is opened during the thread take-up operation. Therefore, the end of the needle thread is not drawn toward the thread take-up. The operator has only to put the needle thread along the guide groove and does not have to prepare the needle thread twice for the thread take-up operation and the threading operation.

17 Claims, 14 Drawing Sheets

SEWING MACHINE WITH AUTOMATIC THREAD TAKE-UP AND THREADING

BACKGROUND OF THE INVENTION

The present invention relates to a sewing machine for automatic thread take-up and threading. More specifically, the present invention relates to a sewing machine in which a needle thread is automatically taken up by a needle take-up and threaded through an eye of a needle prior to sewing operation.

Prior-art sewing machines can automatically perform the thread take-up operation of a needle thread by a thread take-up (hereafter referred to as "thread up operation") or threading operation to the eye of a needle (hereafter referred to as "threading operation") prior to sewing.

For example, Japan Published Unexamined Patent Application H1-113092 discloses a sewing machine, where a hook for threading is driven to pass through the eye of a needle by means of an air cylinder and an operator manually hangs a needle thread on the hook. Thus, the threading operation can be executed somewhat automatically.

On the other hand, in a sewing machine proposed in Japan Published Examined Utility Model Application S63-228, the thread take-up operation is executed automatically. A needle thread strung intersecting an area where a thread take-up moves is pushed out when the thread take-up swings down and then is picked up by a hook at an end of the thread take-up when the thread take-up swings up. The needle thread needs to be strung with appropriate tensile strength so as not to be slackened off when pushed out by the thread take-up.

The combination of the above-mentioned two sewing machines would seem to produce a sewing machine which can automatically perform both the thread take-up operation and the threading operation. Such a combined sewing machine, however, would have the following problems. When the needle thread is caught by the thread take-up, the needle thread is extracted from the upstream side above the thread take-up, namely from a bobbin, and also from the downstream side. Accordingly, the needle thread at the downstream side below the thread take-up has to be about 12 cm or longer. Consequently, when the threading operation is executed before the thread take-up operation, the needle thread of about 12 cm or longer must be passed through the eye of the needle, which cannot be automatically executed because of the extreme length. Accordingly, before the thread take-up operation, the operator must pull out the needle thread about 12 cm or longer which is automatically prepared beyond the eye of the needle about several millimeters through about several centimeters. In addition, he must hold onto the free end of the needle thread by hand because the thread take-up swinging up at high speed would otherwise pull the needle thread out of the eye.

Another problem exists when the thread take-up operation is executed before the threading operation. Before the thread take-up swings down, the needle thread has to be strung with appropriate tensile strength so as to cross the thread take-up moving area and be slackened more than 12 cm such that the end of the needle thread does not get out of place when the thread take-up swings down. Further, the needle thread must be prepared for the threading operation at the downstream side below the thread take-up after the thread take-up operation has finished. Accordingly, the thread take-up operation and the threading operation are separately performed, and the operator must prepare the needle thread twice for the thread take-up operation and the threading operation.

Therefore, the object of this invention is to provide a sewing machine for automatic thread take-up and threading that can perform the thread take-up operation and the threading operation without failure after simple preparation of the needle thread.

Other objects and benefits of the invention will become apparent from the detailed description which follows hereinafter when taken in conjunction with the drawing figures which accompany it.

SUMMARY OF THE INVENTION

To attain the foregoing object, this invention provides a sewing machine for automatically taking up needle thread w by a thread take-up W6 and threading to the eye W8 of a needle W7, which comprises, as shown in FIG. 1, needle thread guide means M1 for guiding the needle thread w from a needle thread supply source W1 to a threading preparatory position P2 near the end of a needle bar W3 via a thread take-up preparatory position P1 intersecting a thread take-up moving area W2, thread take-up means M2 for extracting the needle thread w at the thread take-up preparatory position P1 along the thread take-up moving area W2 and for taking up the needle thread w using a thread take-up member W5 and/or the thread take-up W6 both provided at one end of the thread take-up moving area W2 when a thread tension member W4 is opened, and positioning means M3 for keeping the end of the needle thread w guided to the threading preparatory position P2 and for positioning the needle thread w in front of or at the rear of the eye W8 of a needle W7, threading means M4 for performing the threading operation of the needle thread w to the eye W8, and prohibiting means M5 for prohibiting the threading operation until the thread take-up operation is over.

In the sewing machine for automatic thread take-up and threading of the present invention, the needle thread guide means M1 conducts the needle thread w as pulled from the needle thread supply source W1 to the thread take-up preparatory position P1 and the threading preparatory position P2. The thread take-up means M2 prepares the needle thread w guided to the thread take-up position P1 along the thread take-up moving area W2 and the needle thread w is caught by the thread take-up W6 and/or the thread take-up member W5. During this operation, the prohibiting means M5 prohibits the threading operation to the eye W8 of the needle W7 by the threading means M4. Therefore, the end of the needle thread w is kept by the positioning means M3. Consequently, the needle thread w is pulled only from the needle thread supply source W1 through the opened tension member W4 without being pulled backward by the thread take-up.

In the sewing machine for automatic thread take-up and threading, in order to perform the thread take-up operation by the thread take-up W6 and the like and the threading operation through the eye W8, the operator has only to put the needle thread w along the needle thread guide means M1.

DETAILED DESCRIPTION OF THE PREFERRED EMBODIMENTS

A sewing machine for automatic thread take-up and threading embodying the present invention is described in detail with reference to the attached drawings.

Figure 1:
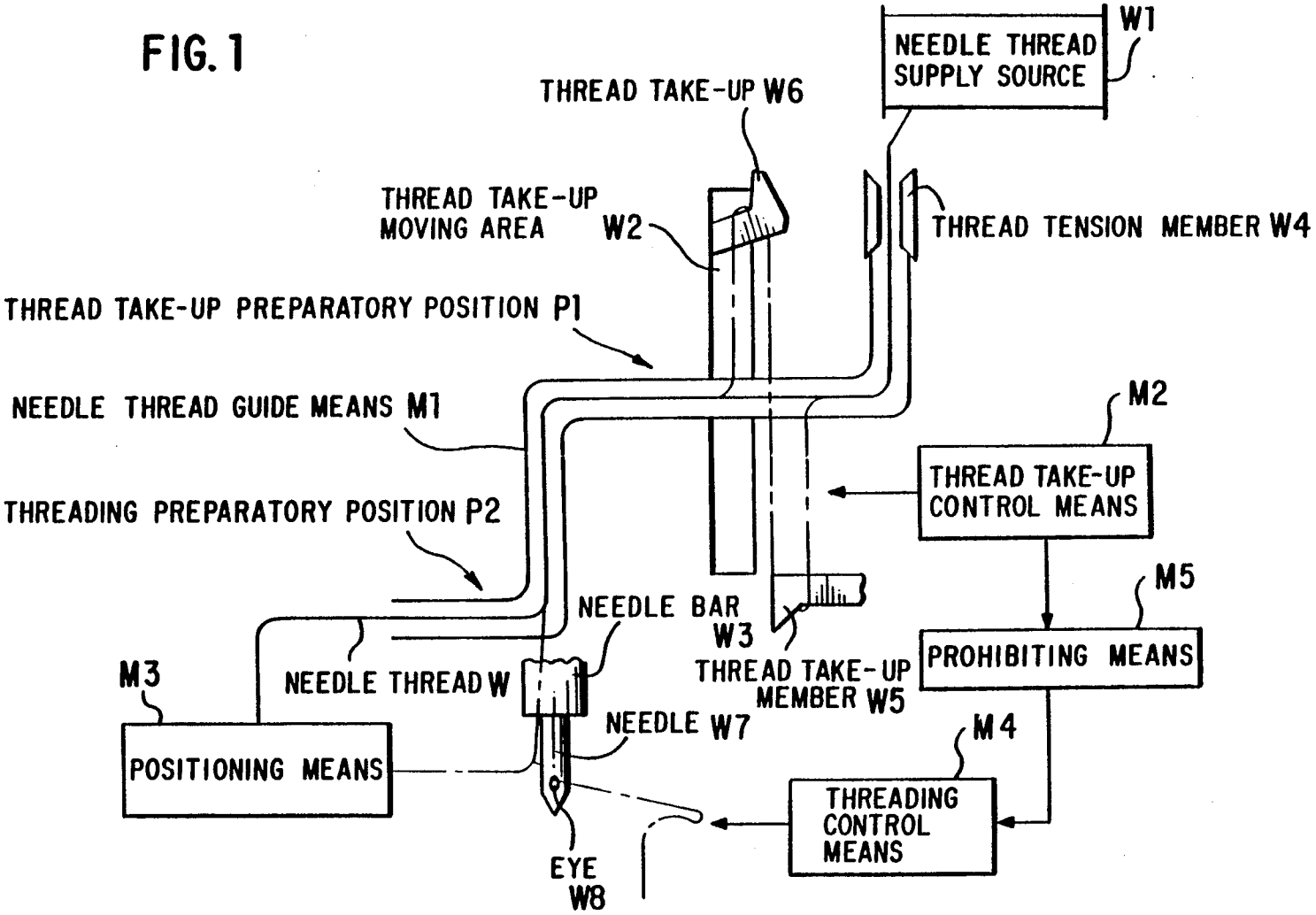
FIG. 1 is a block diagram showing the construction of a sewing machine for automatic thread take-up and threading of the present invention.
Figure 2:
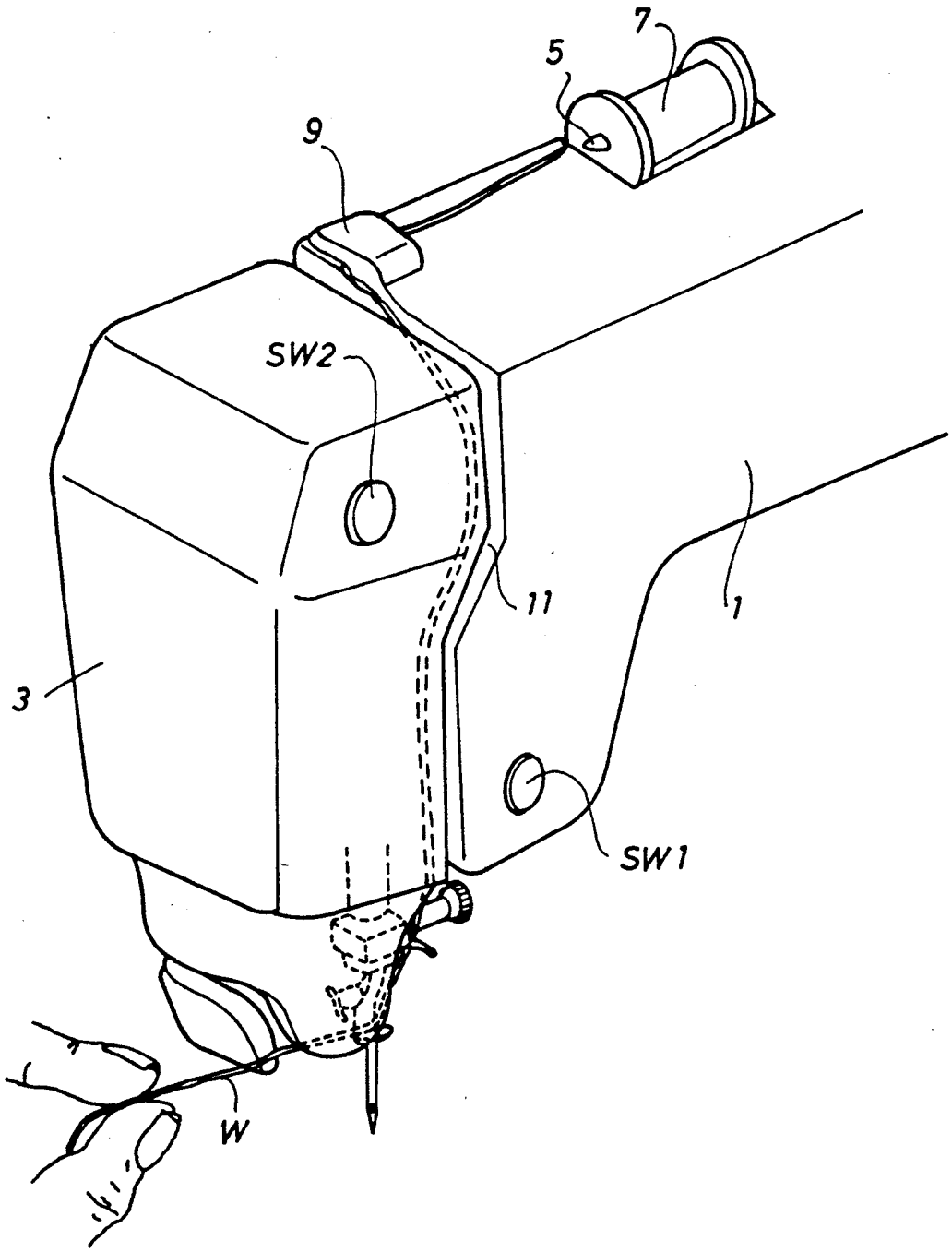
FIG. 2 is a perspective view of the sewing machine for automatic thread take-up and threading.

FIG. 2 is a perspective view showing a head 1 of the sewing machine for automatic thread take-up and threading seen from the side of a face plate 3.

On the top face of the head 1 an arm spool pin 5 and a top thread holder 9 are provided. A bobbin 7 is put on the arm spool pin 5, and a needle thread w from the bobbin 7 is held by the top thread holder 9 and led to the front of the head 1. A guide groove 11 beginning directly before the top thread holder 9 intersects the top face, extends downward in the front face of the head 1, passes under the face plate 3, and ends at the rear of the face plate 3.

On both sides of the guide groove 11 on the front face of the head 1, a start switch SW1 and a threading switch SW2 are attached. The start switch SW1 at a lower position instructs the start of the sewing operation. The threading switch SW2 at a higher position instructs the thread take-up operation by a thread take-up and the threading operation to the eye of a needle, both of which are explained later.

Figure 3:
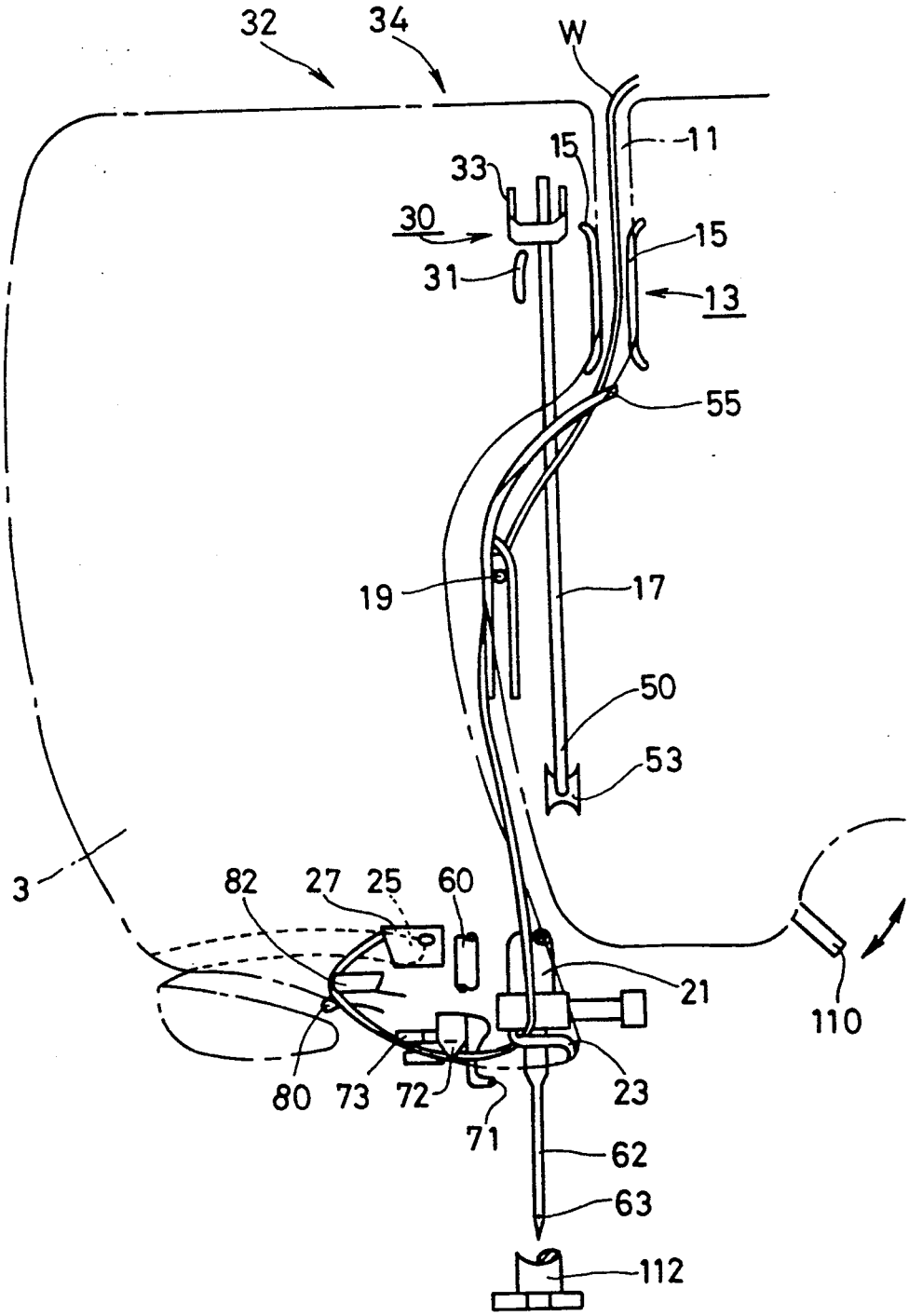
FIG. 3 is a front view showing a guide groove of the sewing machine.

As shown in FIG. 3, a front view, the guide groove 11 passes between a pair of tension discs 15 of a tension member 13, obliquely intersecting approximately the middle portion of a thread guide 17 above a thread take-up spring 19, and goes around a needle-bar thread guide 23 provided under a needle bar 21. Further, the guide groove 11 passes under the front portion of the face plate 3 and ends at a terminal 25 at the rear of the face plate 3. A thread cutter 27 is attached to the terminal 25 of the guide groove 11.

Figure 4B:
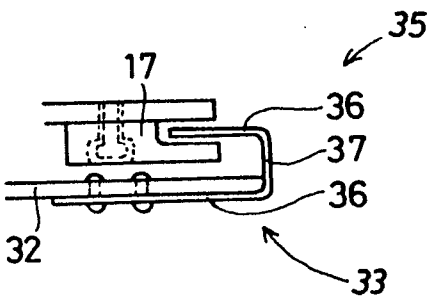
FIG. 4B is a partial top view of the thread take-up.
Figure 4C:
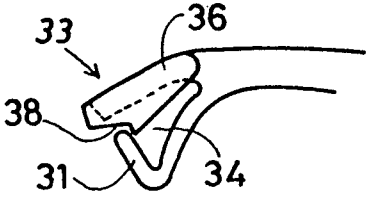
FIG. 4C is a partial rear view of the thread take-up.
Figure 4A:
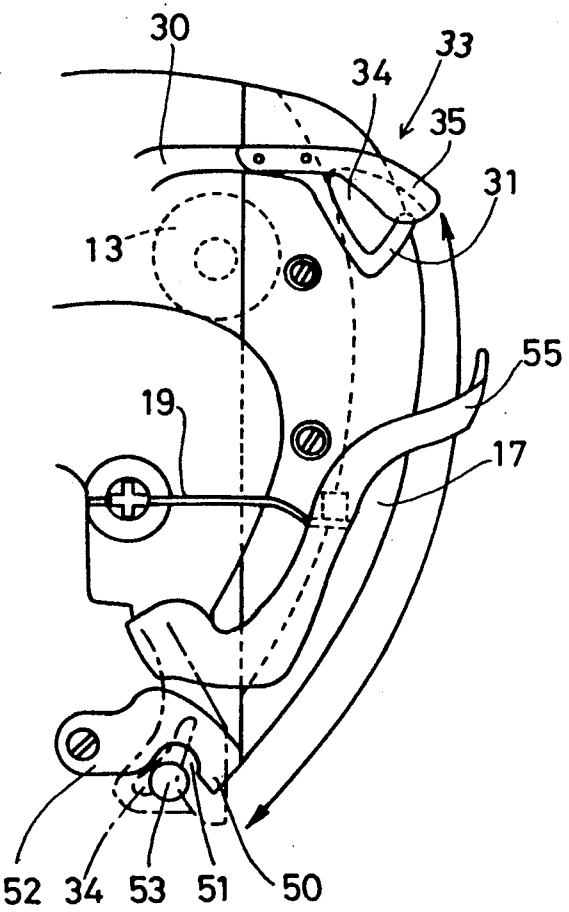
FIG. 4A is a front view of a thread take-up of the sewing machine.

Inside of the head 1 a thread take-up 30 is provided in the front portion of the guide groove 11 so as to swing vertically in front of the thread guide 17. As shown in FIGS. 4A through 4C, the thread take-up 30 comprises a claw 31 bent upward for catching the needle thread w, a cover rod 32 provided over the claw 31, and a pressing cover 33 fixed to the cover rod 32. The claw 31 and the pressing cover 33 form a thread holding hole 34. Seen from the face plate 3, the thread holding hole 34 is a slightly curved narrow hole, as shown in FIG. 4A.

The pressing cover 33 is almost U-shaped in cross section seen from the top and surrounds the thread guide 17, as shown in FIG. 4B. A front panel 35, a rear panel 36, and a connecting panel 37 compose the pressing cover 33. The front panel 35 is positioned in front of the thread guide 17 and the rear panel 36 is behind the thread guide 17. The connecting panel 37 connects the front panel 35 and the rear panel 36.

The claw 31 contacts with the front panel 35 at its tip and is slightly curved toward the thread guide 17, as shown in FIG. 3. A notch 38 is formed in the rear panel 36, as shown in FIG. 4C, such that the tip of the claw 31 projects beyond the pressing cover 33 through the notch 38.

Figure 5:
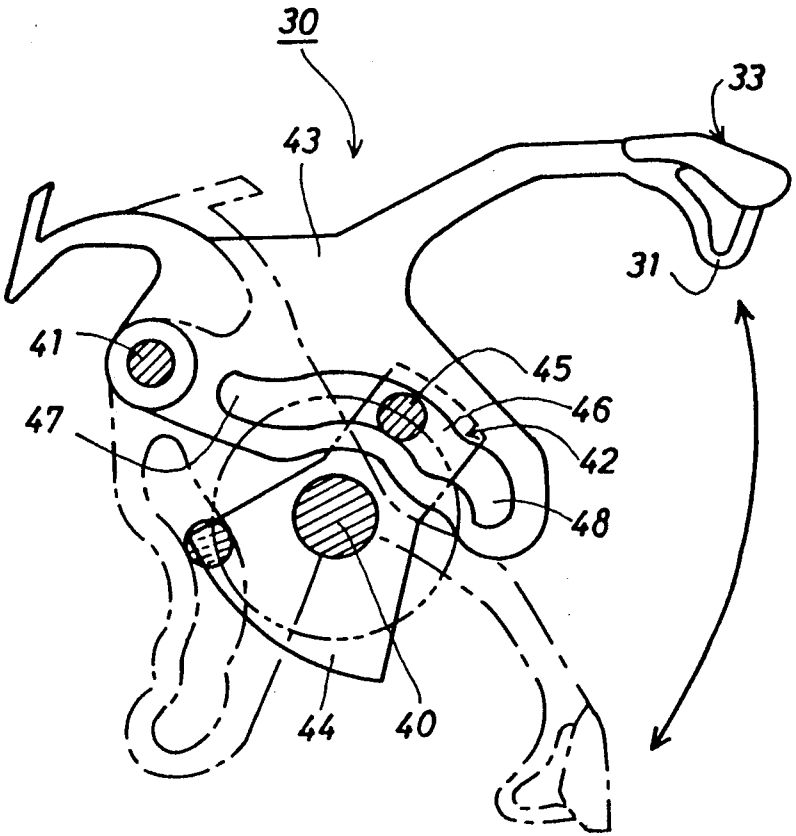
FIG. 5 explains the operation of the thread take-up.

As shown in FIG. 5, a base 43 of the thread take-up 30 is rotatably provided on an auxiliary shaft 41. The auxiliary shaft 41 is parallel with an arm shaft 40. The base 43 has a cam slot 42 in the neighborhood of the auxiliary shaft 41. A crank pin 45 of a thread take-up crank 44 fixed to the arm shaft 40 is movable in the cam slot 42. The cam slot 42 has three portions; an arc portion 46 in the middle, a linear portion 47 at one end near the auxiliary shaft 41, and a short arc portion 48 at the other end. The arc portion 46 has a curvature approximately equal to that of the partial circle made by the rotation of the crank pin 45. The curvature of the short arc portion 48 is smaller than that of the arc portion 46. The thread take-up 30 moves by the engagement of the cam slot 42 and the crank pin 45, as shown by an arrow in FIG. 5, when the arm shaft 41 is rotated. The relative positions of the cam slot 42 and the crank pin 45 are adjusted such that the thread take-up 30 goes down beyond a lower end portion 50 of the thread guide 17, as shown by a dashed line in FIG. 4A.

At the lower end portion 50 of the thread guide 17, a thread receiver 52 is positioned, as shown in FIG. 4A. The thread receiver 52 has a dent 51 in its lower portion. A press roller 53 provided in the dent 51 is brought close to or apart from the thread receiver 52 by a cam mechanism (not shown) during the sewing operation, thus adjusting the tension of the needle thread w. A guide member 55 is interposed between the thread take-up 30 and the thread receiver 52 so as to cover the thread take-up spring 19 and a portion of the thread guide 17.

As shown in FIG. 3, near the curved portion of the guide groove 11 at the bottom of the face plate 3, a lower end of a threading member shaft 60 is provided. The threading member shaft 60 is parallel with the needle bar 21. The following is an explanation of the threading member shaft 60 and other relative components.

Figure 6:
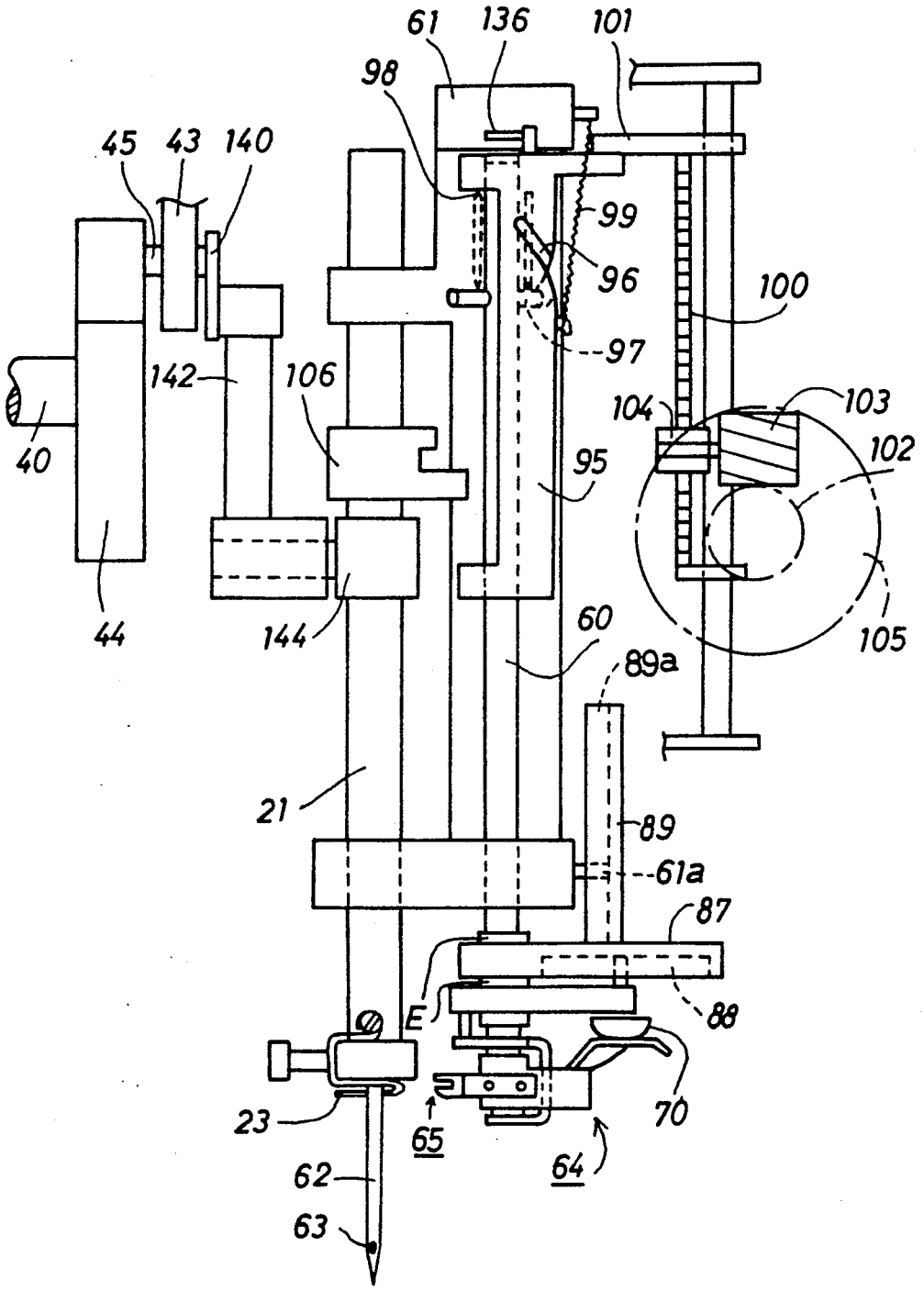
FIG. 6 is a rear view showing a needle bar and a threading member shaft provided in a head of the sewing machine.

FIG. 6 shows the inside of the face plate 3. A frame body 61 supports the needle bar 21 and the threading member shaft 60. The threading member shaft 60 is vertically movable along an axis parallel with that of the needle bar 21 and is also rotatable around the axis. The threading member shaft 60 is connected to a thread positioning member 64 and a threading member 65. The thread positioning member 64 strings the needle thread w in front of the eye 63 of a needle 62 by the cooperation of a guide mechanism and a linkage mechanism described later, when the threading member shaft 60 is vertically moved and then rotated. The threading member 65 introduces the strung needle thread w into the eye 63.

Figure 7A:
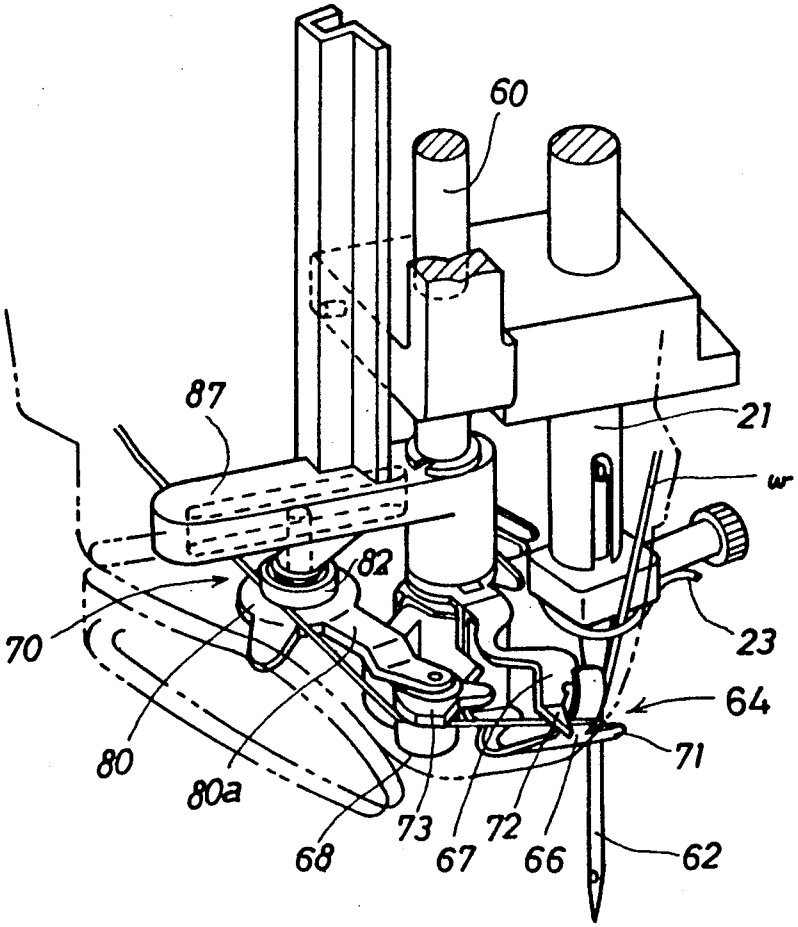
FIG. 7A is a perspective view of a thread positioning member provided at the lower end of the threading member shaft.

As shown in FIG. 7A, the thread positioning member 64 is composed of a first positioning part 66 provided near the needle-bar thread guide 23, a second positioning part 67 provided behind the first positioning part 66, a third positioning part 68 provided behind the second thread tension part 67 and a thread end keeping member 70 provided above and behind the three positioning parts 66, 67 and 68. The positioning parts 66, 67 and 68 are almost at the same height.

A thread holding protrusion 71 projects from the lower portion of the first positioning part 66 toward the needle bar 21. A pressing protrusion 72 is formed at the lower portion of the second positioning part 67, is positioned slightly above the thread holding protrusion 71 of the first positioning part 66, and projects forward beyond the first positioning part 66. In addition, a thread pressing piece 73 on the third positioning part 68 is as high as the thread pressing protrusion 72 of the second positioning part 67 and extends forward.

Figure 7B:
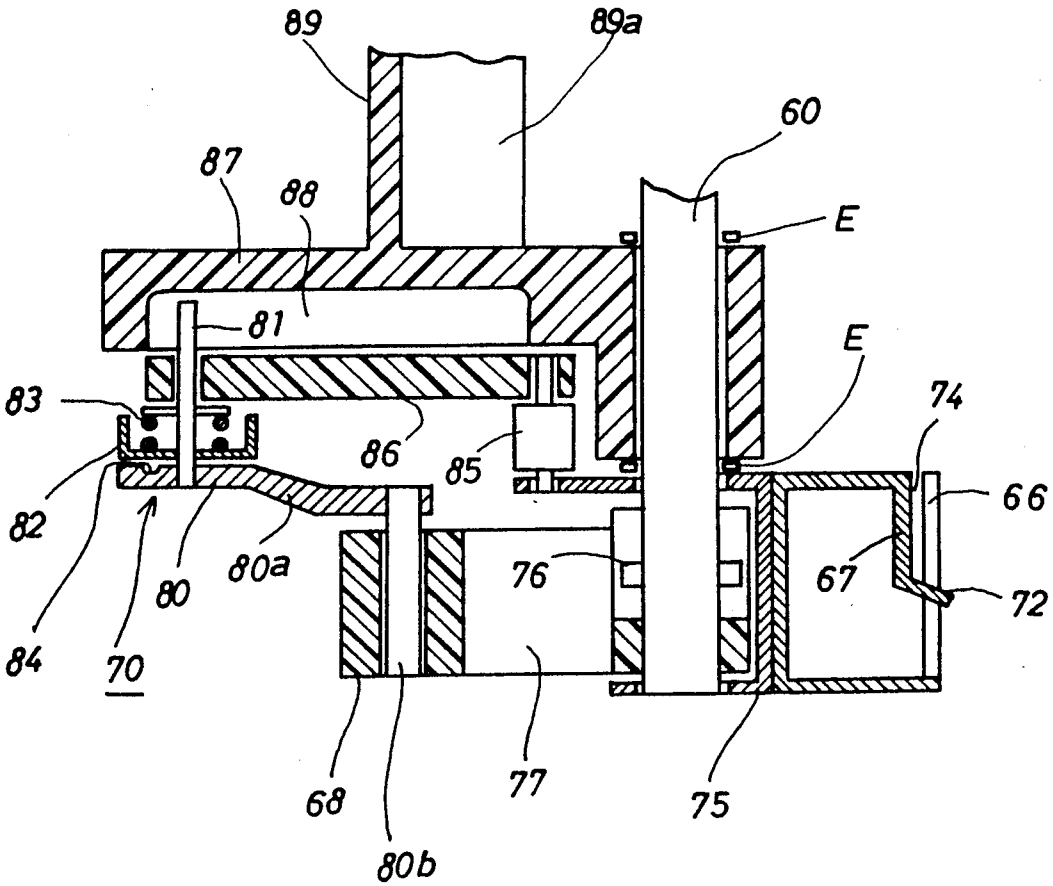
FIG. 7B is a cross-sectional view of the thread positioning member in a stretched condition.

The first and the second positioning parts 66 and 67 are integrally formed of a plate material and have an approximate square cross section, as shown in FIG. 7B. A part of the second positioning part 67, which is in communication with the thread pressing protrusion 72, extends in parallel with the first positioning part 66 with an appropriate space 74 therebetween. Both the first positioning part 66 and the second positioning part 67 are directly fixed to a U-shaped metal fitting 75, which is rotatable around the threading member shaft 60.

The third positioning part 68 is provided at a free end of a rotating arm 77, whose other end is fixed to the threading member shaft 60 via a rotation stop pin 76.

The thread end keeping member 70 comprises a press plate 80 for pushing up the guided needle thread w and a press disc 82 freely movable on a support 81 provided on the press plate 80. The press disc 82 is forced downward by a spring 83 attached around the support 81. On the press plate 80, a receiving groove 84 is formed in the tangential direction of the support 81 in the vicinity of the support 81.

The thread end keeping member 70 is rotatably supported by the third positioning member 68 via a support shaft 80*b* which projects downward from an arm 80*a* integrally formed as part of the press plate 80.

The end portion of the upper and longer leg of the U-shaped metal fitting 75 is loosely engaged with a deformed pin 85 having a larger-diameter portion in its longitudinally middle portion. The thread end keeping member 70 is connected to the U-shaped metal fitting 75 via a connecting lever 86 which is loosely engaged with the deformed pin 85 and the support 81 at its respective ends. The support 81 is slidable in a guide cavity 88 formed in the bottom face of a slidable guide 87.

The slidable guide 87 freely rotates around the threading member shaft 60 and is prevented from moving vertically because of locating E-shaped snap rings positioned on and under the slidable guide 87. A vertical guide member 89 having a U-shaped cross section with a longitudinal groove is fixed to the slidable guide 87, as shown in FIG. 6. A pin 61*a* projects horizontally from the bottom of the frame body 61. The guide member 89 and the slidable guide 87 integrally slide up and down since the pin 61*a* and the groove of the guide member 89 are engaged. Consequently, the slidable guide 87 vertically moves the threading member shaft 60 via the guide member 89 and horizontally moves the support 81 via the guide cavity 88 in its underside.

Figure 8:
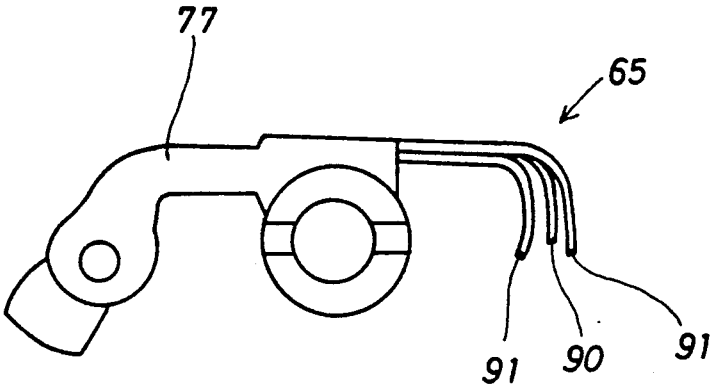
FIG. 8 is a top view of a part of the thread positioning member and the threading member.
Figure 9:
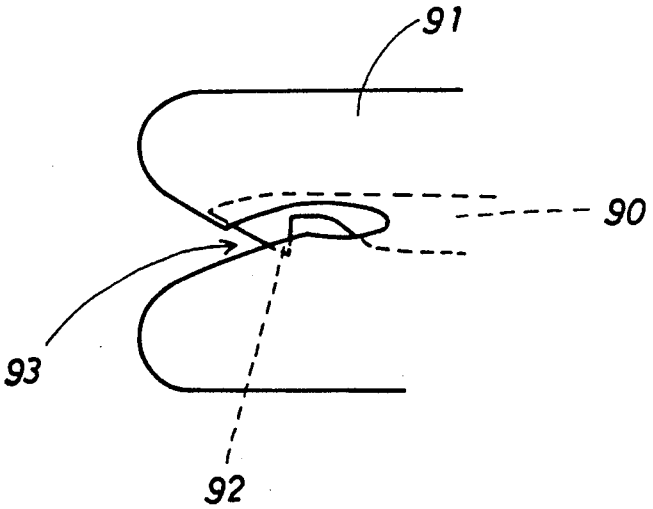
FIG. 9 is a partial side view of the threading member.

The threading member 65 provided at the rear end of rotating arm 77 comprises a threading hook 90 and a pair of hook guards 91. Seen from the top, the threading hook 90 extends to the right and bends to the front in its middle portion, as shown in FIG. 8. The pair of hook guards 91 are provided on both sides of the threading hook 90 and is bent along the threading hook 90. As shown in FIG. 9, each of the hook guards 91 has a leading notch 93 in its end for leading the needle thread w to a projection 92 of the threading hook 90.

The thread positioning member 64 and the threading member 65 having the aforementioned construction operate at their predetermined positions in exact timing with each other, when the threading member shaft 60 vertically moves and then rotates.

On the upper portion of the threading member shaft 60 a guide member 95 is slidably provided. The guide member 95 has a cam notch 96 comprising an elongated slot formed obliquely. One end of an engagement pin 97 passing through the threading member shaft 60 is engaged with the cam notch 96. The threading member shaft 60 is biased upward by a spring 98 linking the top board of the guide member 95 and the engagement pin 97. Therefore, the engagement pin 97 normally abuts the lowest end of the cam notch 96.

The guide member 95 is connected to the top of the frame body 61 via a spring 99, thus being forced upward. The top of the guide member 95 is pushed by a press board 101 provided at the upper end of a rack 100. The rack 100 is moved up and down in parallel with the threading member shaft 60 by a pulse motor 105 via gears 102, 103 and 104.

When the rack 100 descends, the threading member shaft 60 goes down together with the guide member 95 until the left end (seen from the rear) of the engagement pin 97 abuts an abutting member 106 fixed at a predetermined position on the needle bar 21. The position of the abutting member 106 is determined by the position of the eye 63 of the needle 62. Specifically, when the threading member shaft 60 is stopped by the abutting member 106, the threading hook 90 is as high as the eye 63. Subsequently, when the rack 100 further descends, the threading member shaft 60 is rotated because the engagement pin 97 is moved in the cam notch 96.

In accordance with the aforementioned movement of the threading member shaft 60, the thread positioning member 64 and the threading member 65 operate as follows.

Figure 10A:
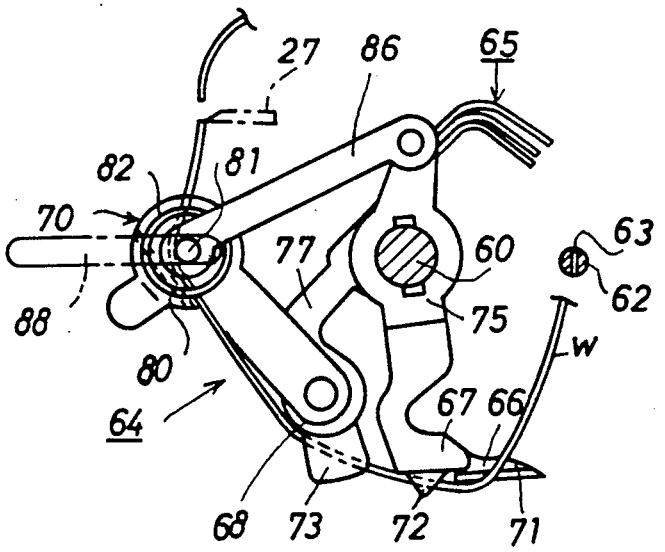
FIG. 10A through 10C are top views of the operation of the thread positioning member.
Figure 10B:
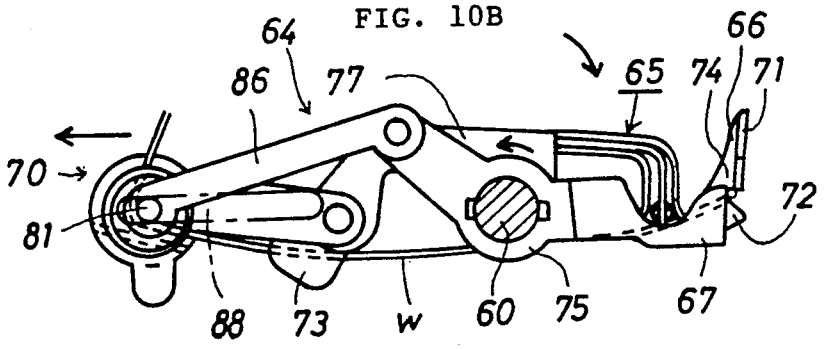
Figure 10C:
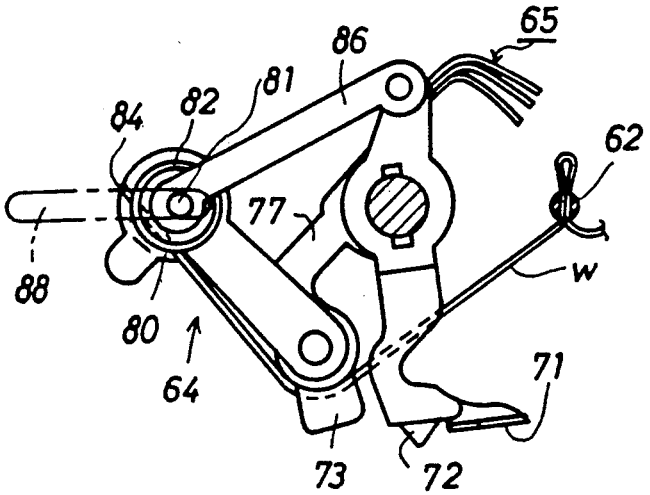

When the threading member shaft 60 rotates clockwise as depicted in FIG. 10A, the thread tension member 64, the threading member 65, and other components shift from the condition shown in FIG. 10A to that shown in FIG. 10B. Specifically, the rotating arm 77 is rotated clockwise together with the threading member shaft 60, the press plate 80 is pushed leftward, and the support 81 slides leftward in the guide cavity 88. In addition, the U-shaped metal fitting 75, which is pulled by the connecting lever 86, rotates counterclockwise. As a result, the thread positioning member 64 is stretched and the distance between the first and second positioning parts 66 and 67 and the thread end keeping member 70 becomes largest, as shown in FIG. 10B. Under this condition, the threading hook 90 is inserted into the eye 63 of the needle 62. Subsequently, the threading member shaft 60 is rotated counterclockwise and the thread positioning member 64 is contracted again, as shown in FIG. 10C.

The introduction of the needle thread w along the guide groove 11 and to the thread positioning member 64 is best explained with reference to FIGS. 2, 3, 7A and 10A.

By operating a presser-foot lever 110 provided on the head 1 behind the needle bar 21 on the head 1, a presser foot 112 is raised and the tension member 13 is opened. The needle thread w is then pulled from the bobbin 7, held by the top thread holder 9, and is led in the guide groove 11 from the front face to the rear face of the head 1. As a result, the needle thread w passes between the tension discs 15 of the tension member 13, is caught by the thread take-up spring 19 and the needle-bar thread guide 23. The needle thread w further passes on the thread holding protrusion 71 of the first positioning tension part 66, under the thread pressing protrusion 72 of the second positioning part 67 and the thread pressing piece 73 of the third positioning part 68. After that, the needle thread w is inserted between the press plate 80 and the press disc 82 of the thread end keeping member 70, and is cut by the thread cutter 27.

The needle thread w is thus led to the thread positioning member 64, as shown in FIG. 10A. Since the needle thread w reaches the terminal 25 of the guide groove 11, the needle thread w is securely held by the thread end keeping member 70 such that the needle thread w is in contact with the lower end of the support 81. The needle thread w is slightly slackened off in the guide groove 11.

Figure 11:
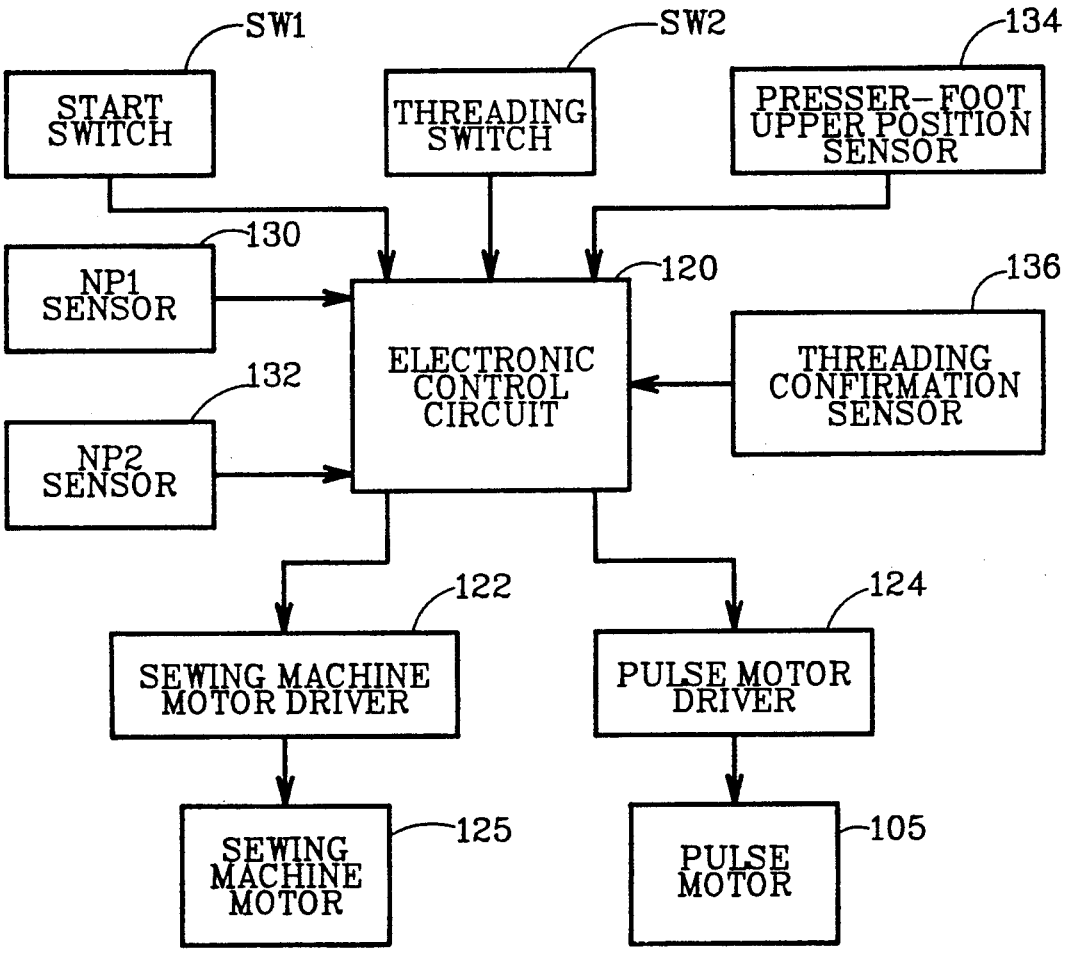
FIG. 11 is a block diagram for a control system for the sewing machine.

The control system of the sewing machine for automatic thread take-up and threading is described referring to FIG. 11.

The control system is mainly composed of an electronic control circuit 120, which comprises a CPU, ROM, RAM, and the like, and controls the thread take-up operation, the threading operation and the sewing operation. To the electronic control circuit 120, the start switch SW1 and the threading switch SW2 are connected at its input side, and a sewing machine motor 125 and the pulse motor 105 are connected at its output side via a sewing machine motor driver 122 and a pulse motor driver 124, respectively. An NP1 sensor 130 and an NP2 sensor 132 are also connected to the electronic control circuit 120. The NP1 sensor 130 sends out a detection signal when the needle bar 21 is in its highest position (hereafter referred to as NP1) as determined from the phase angle of the arm shaft 40. The NP2 sensor 132 sends out a detection signal when the thread take-up 30 is at its highest position (hereafter referred to as NP2) also determined from the phase angle of the arm shaft 40. Furthermore, to the electronic control circuit 120, a presser-foot upper position sensor 134 and a threading confirmation sensor 136 are connected. The presser-foot upper position sensor 134 sends out a detection signal when the presser foot 112 is raised using the presser-foot lever 110, in other words, when the tension member 13 is opened. The threading confirmation sensor 136 attached on the top of the guide member 95, as shown in FIG. 6, sends out a detection signal when the upper end of the threading member shaft 60 projects beyond a prescribed position.

Figure 12:
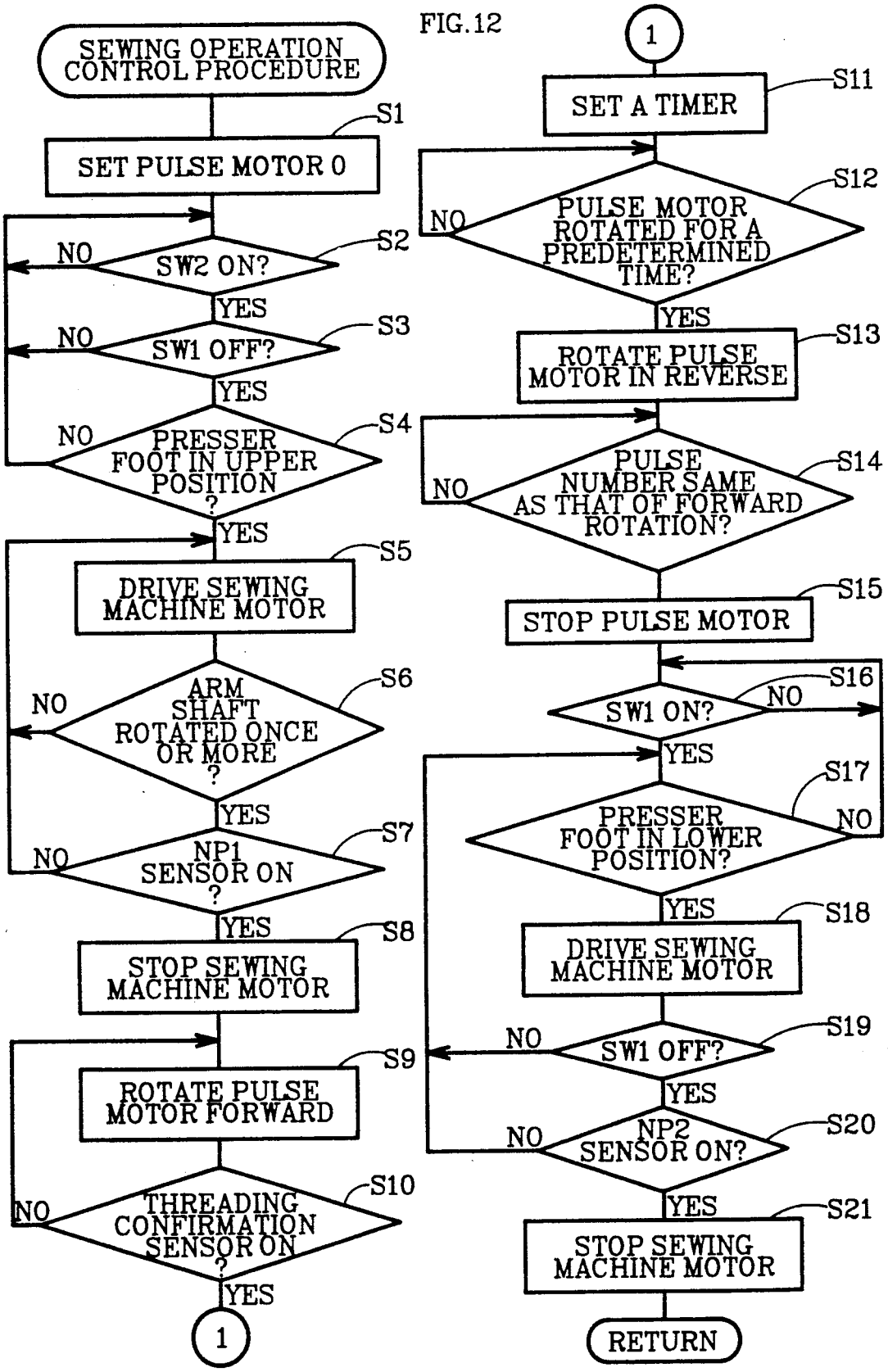
FIG. 12 is a flowchart for the control procedure performed by the control system.

FIG. 12 is a flow chart showing the control procedure executed by the electronic control circuit 120. As described above, the needle thread w extracted from the bobbin 7 is led to a predetermined position along the guide groove 11. When it is turned on, the sewing machine is initialized and its motors, including the pulse motor 105, are set 0 at step S1.

Subsequently, the threading switch SW2 is pressed. When it is determined at step S2 that the threading switch SW2 is on, it is asked at the next step S3 whether the start switch SW1 is off or not. When the answer is affirmative, the electronic control circuit 120 proceeds to step S4, where it is asked whether the presser foot 112 is in its upper position and the tension member 13 is opened. When the start switch SW1 is on or when the presser foot 112 is not raised, the procedure goes back to step S2. The threading switch SW2 must be pressed again when the answer at step S3 or step S4 is negative, because the threading switch SW2 momentarily operates.

When the start switch SW1 is off and the presser foot 112 is in its upper position, the sewing machine motor 125 is driven at step S5.

Figure 13C:
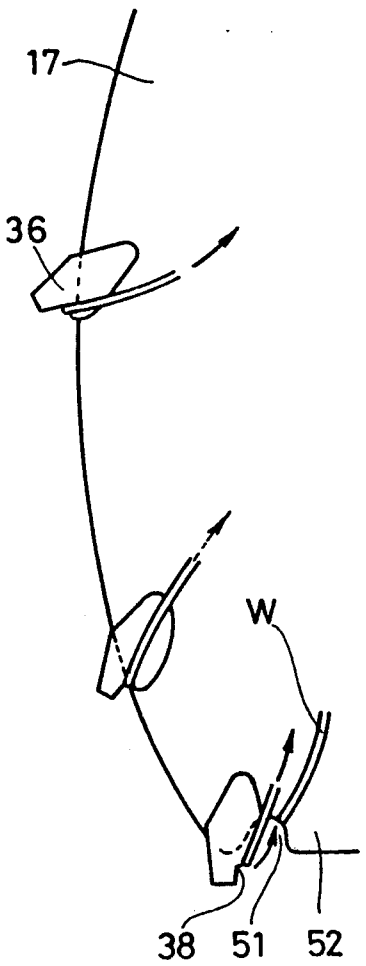
FIG. 13A through 13C explain the thread take-up operation by the thread take-up.
Figure 13B:
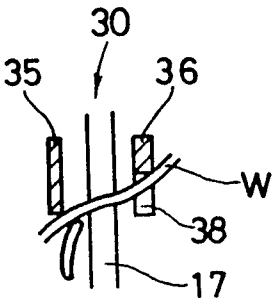
Figure 13A:
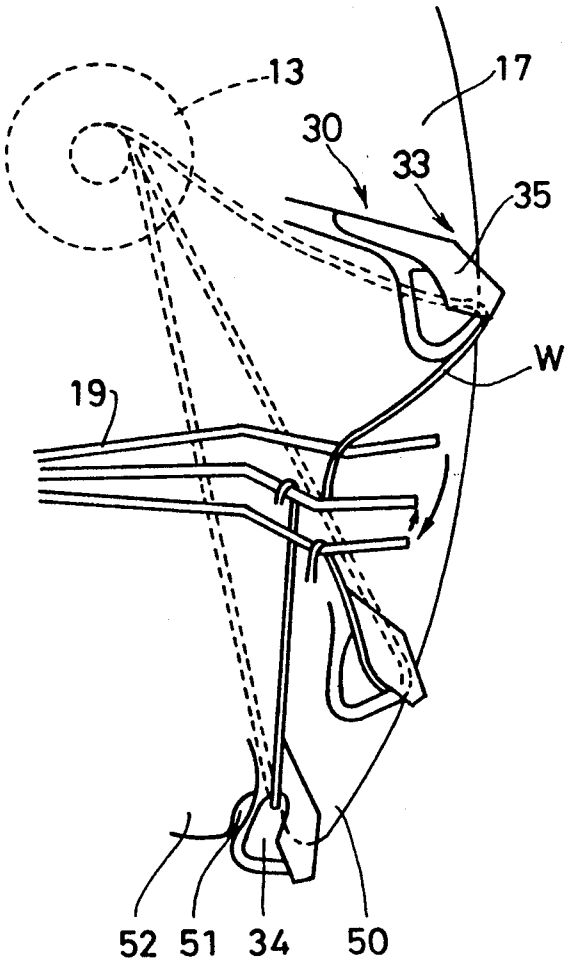

When the sewing machine motor 125 is driven, the needle thread w is taken up by the thread take-up 30, as shown in FIGS. 13A through 13C.

When the thread take-up 30 is swung downward, the needle thread w crossing almost the middle portion of the thread guide 17 is caught by the pressing cover 33 provided at the end of the thread take-up 30. The needle thread w abuts the under sides of the front panel 35 and the notch 38 of the rear panel 36. As the thread take-up 30 is further swung downward, the thread take-up 30 pulls the needle thread w along the thread guide 17. At this time the needle thread w is effectively pulled only from the bobbin 7, because the tip of the needle thread w is held by the thread end keeping member 70 and the tension member 13 is opened.

The thread take-up 30 continues until it is beyond the lower end portion 50 of the thread guide 17. After that, the thread guide 17 does not prevent the needle thread w from slipping from between the front panel 35 and the rear panel 36 and entering the thread holding hole 34. In addition, the thread take-up spring 19 leaps up. Consequently, the needle thread w is pulled up, is slipped from the notch 38 of the pressing cover 33 and enters the dent 51 of the thread receiver 52 and the thread holding hole 34. The needle thread w never goes up beyond the lower end portion 50 even when the thread take-up 30 swings up, because the deepest portion of the thread holding hole 34 is above the lower end portion 50.

The needle thread w is thus taken by the thread take-up 30. Although the needle thread w is caught by the thread take-up 30 after the thread take-up 30 once swings down, it is asked at step S6 for confirmation whether the arm shaft 60 rotated once or more such that the needle thread w never fails to be taken regardless of the initial position of the thread take-up 30.

After the sewing machine motor 125 rotates once or more, the phase angle of the arm shaft 40 is NP1. Then, it is determined at step S7 whether the NP1 sensor 130 output a detection signal. If the answer at step S7 is affirmative, the sewing machine motor 125 is stopped at step S8.

While the arm shaft 40 is rotated by the sewing machine motor 125, the needle bar 21 is driven vertically together with a needle bar connecting stud 144 by a needle-bar crank 142 connected to the end of the crank pin 45 via a connecting board 140, as shown in FIG. 6. The crank pin 45 passes through the base 43 of the thread take-up 30. When the sewing machine motor 125 is stopped in response to the detection signal from the NP1 sensor 130, the needle bar 21 is placed in the vicinity of its highest position. Accordingly, since the needle thread w is threaded to the eye 63 of the needle 62 when the presser foot 112 is raised, the presser foot 112 does not interfere with the thread positioning member 64 and the threading member 65.

Subsequently, the pulse motor 105 is rotated forward at step S9, the rack 100 is lowered, and the needle thread w is threaded through the eye 63 of the needle 62, as shown in FIGS. 10A through 10C and FIGS. 14A through 14C.

As described above, when the pulse motor 105 rotates forward, the threading member shaft 60 is lowered. After the threading hook 90 is just beside the eye 63, the threading member shaft 60 stops being lowered and is rotated. Consequently, the thread positioning member 64 is stretched out and the first and the second positioning parts 66 and 67 are positioned at the right of the needle 62, as shown in FIG. 10B. Under this condition, the needle thread w is pulled from the bobbin 7 and is strung in front of the eye 63 of the needle 62 because the free end of the needle thread w is pinched by the thread end keeping member 70. The needle thread w is led to the under side of the first positioning member 66 through the space 74 and is positioned near the eye 63.

Figure 14C:
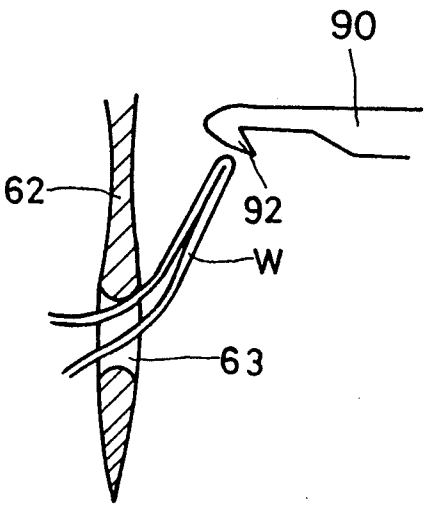
FIG. 14C is a cross-sectional view showing the operation of the threading member.
Figure 14B:
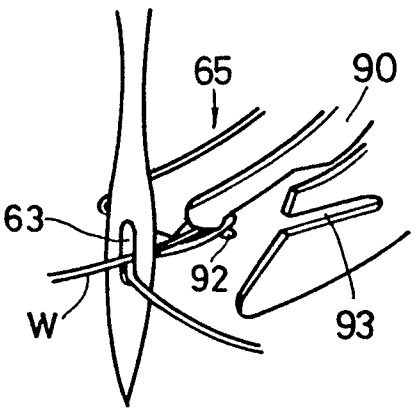
FIG. 14A and 14B are perspective views showing the operation of the threading member.
Figure 14A:
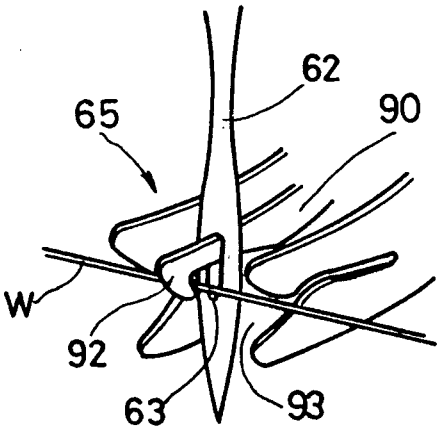

At the same time, the threading member 65 is also rotated and the threading hook 90 passes through the eye 63, as shown in FIG. 14A. The needle thread w is led along the leading notch 93 and is caught by the projection 92.

When the needle thread w is caught by the threading hook 90 through the eye 63, the threading confirmation sensor 136 sends out a signal at step S10. After the threading confirmation sensor 136 turns on, a timer is set at step S11 and the pulse motor 105 is rotated forward at step S12 until a predetermined time elapses. The pulse motor 105 is rotated such that the needle thread w is securely held by the threading hook 90, because the needle thread w fails to be caught by the threading hook 90 in some cases.

After the predetermined time, the number of pulses, C, required for the forward rotation of the pulse motor 105 is stored in a specified memory location in the electronic control circuit 120 for later retrieval. Then, the pulse motor 105 is rotated in reverse at step S13. As shown in FIG. 10C, the thread positioning member 64 is contracted again, the threading member 65 is also rotated, and the threading hook 90 comes out of the eye 63 because the threading member shaft 60 is rotated. When the threading member shaft 60 is further rotated, the engagement pin 97 abuts the lower end of the cam notch 96 and the rotation of the threading member shaft 60 is stopped. The threading member shaft 60 is raised in combination with the guide member 95.

As shown in FIGS. 14B and 14C, the needle thread w caught by the threading hook 90 is pulled through the eye 63. At this time, the end of the needle thread w is detached from the support 81 and slipped away from between the press plate 80 and press disc 82 along the receiving groove 84, as shown in FIG. 10C.

At step S14 the pulse motor 105 is rotated in reverse the same number of pulses, C, stored in memory previously. The pulse motor 105 is stopped at step S15.

The thread take-up operation and the threading operation are thus performed. Subsequently, the start switch SW1 is pressed at step S16 and the electronic control circuit 120 instructs the sewing operation.

It is asked at step S17 whether the presser foot 112 is lowered or not. When the presser foot 112 is in its upper position, the procedure goes back to step S16. On the other hand, when the presser foot 112 is in its lower position, the sewing machine motor 125 is driven and the sewing operation begins at step S18. The sewing machine motor 125 continues the sewing operation until the start switch SW1 is pressed again to stop the sewing operation.

When the start switch SW1 is off at step S19 and the NP2 sensor 132 outputs a detection signal, namely, the thread take-up 30 is in its upper position at step S20, the sewing machine motor is stopped at step S21.

Consequently, the arm shaft 40 is stopped in the state that the thread take-up 30 is in its highest position, the needle bar 21 is raised, and the needle 62 is detached from the cloth. The needle thread w can smoothly cast off from a bobbin case (not shown).

As described above, in the present embodiment, the thread take-up operation using the thread receiver 52 and the thread take-up 30 and the threading operation to the eye 63 are executed simply by guiding the needle thread w along the guide groove 11 and pushing the threading switch SW2. The operator is free from the troublesome thread take-up operation and the threading operation. Therefore, the sewing machine can be easily handled by those who usually do not use a sewing machine.

Since the thread positioning member 64 comprises the thread end keeping member 70 for keeping the end of the needle thread w and the thread take-up operation is performed before the threading operation in the state that the tension member 13 are opened, the end of the needle thread w is never drawn by the thread take-up 30. Accordingly, the operator does not have to slacken the needle thread w about 12 cm or longer at the downstream side below the thread take-up 30, as in the prior art nor pinch and hold the end of the needle thread w. Further, the needle thread w does not have to be prepared a second, time for the threading operation. Briefly, the thread take-up operation and the threading operation are automatically executed at the same time. All the operator has to do is to guide the needle thread w from the top thread holder 9 to the terminal 25 along the guide groove 11, which extends from before the bobbin 7 to the rear and lower portion of the face plate 3.

The needle thread w is kept strung by the thread end keeping member 70 until most of the threading operation ends. Therefore, the operator does not have to hold the end of the needle thread w. In addition, the end of the needle thread w is not so short that the end of the needle thread w can come out of the eye 63 of the needle 62 by the abrasion between the needle thread w and the cloth when the needle 62 penetrates the cloth at the first stitch. Consequently, the operator does not have to touch the needle thread w after guiding the needle thread w along the guide groove 11.

Although the thread take-up operation and the threading operation are sequentially performed in this embodiment, the sewing machine can be constructed such that the threading operation does not finish before the thread take-up operation ends. To do this, a thread take-up switch for instructing the thread take-up operation and a threading switch for instructing the threading operation can be separately attached. When the threading switch is pressed, it is confirmed by a flag or the like that the thread take-up operation is already finished.

The thread positioning member 64 and the threading member 65 can be driven by respective drive sources of drive members. In this case, it is not necessary to prevent the threading operation by the threading member 64 from starting before the thread take-up operation is finished. Only the operation for pulling out the needle thread w by the threading member 65 must be prohibited before the thread take-up operation, because the end of the needle thread w must be kept by the thread end keeping member 70.

The thread take-up operation is automatically performed by the sewing machine motor 125 and the threading operation is automatically performed by the pulse motor 105 in this embodiment. Yet, manually operated members can be provided. In order to prevent the threading operation from being finished before the end of the thread take-up operation, some interlocking member can be interposed between the manually operated members, or a plate saying directions, such as that threading operation must not be performed before the thread take-up operation ends, can be attached at or in the vicinity of the manually operated members for the threading operation.

The thread end keeping member 70 does not have to be attached to the terminal of the needle thread w. For example, the needle thread is kept by some component at the upstream side of the needle 62 until the threading operation is over, and on the other hand, the operator holds the end of the needle thread w and introduces the needle thread w to the front of the eye 63. Alternatively, the needle thread w can be positioned in front of the eye 63 by being hooked at some component.

Even if the needle thread w is caught by only one of the thread take-ups 30 and the thread receiver 52, the thread take-up operation is improved as compared with prior-art sewing machines.

Although in this embodiment the thread take-up operation is performed by the swinging thread take-up 30, it can be performed by another component for thread take-up operation swinging along the needle guide 17.

The present invention is not limited to the embodiment described above but includes all embodiments and modifications within the scope and spirit of the invention. For example, although the needle thread w is drawn into the eye 63 by the threading hook 90, the needle thread w can be pushed through the eye 63 or blown through the eye 63 using air.

Therefore, having thus described this invention, what is claimed is:

1. Apparatus included in a sewing machine to provide automatic thread take-up and threading comprising:

a) needle thread guide means for guiding a needle thread from a needle thread supply source to a threading preparatory position in the vicinity of a needle bar via a thread take-up preparatory position intersecting a thread take-up moving area;

b) thread take-up means for extracting said needle thread at said thread take-up preparatory position along said thread take-up moving area, said thread take-up means including a thread take-up member for catching a loop of needle thread;

c) threading means for pulling a loop of said needle thread at said threading preparatory position through an eye of a needle provided at a lower end of said needle bar;

d) signal generating means provided in association with the sewing machine for generating signals when operated by a human operator; and, e) thread take-up and threading control means for controlling said threading means and said thread take-up means in combination in a pre-established timing relationship in response to signals from said signal generating means whereby said threading means pulls a loop of said needle thread through said eye of said needle and said thread take-up member takes up a separate loop of needle thread, said thread take-up and threading control means including prohibiting means for prohibiting a threading operation until a thread take-up operation is completed.

2. The automatic thread take-up and threading apparatus for a sewing machine of claim 1 wherein said threading means comprises:

a) a pair of spaced positioning members disposed on opposite sides of said needle adjacent said eye, each of said positioning members having a guide slot means in a free end thereof positioned for receiving said needle thread and for guiding it across said eye of said needle; and, b) a thread gripping member disposed between said pair of spaced positioning members and having a free end sized and positioned to pass through said eye of said needle, said thread gripping member including releasable gripping means for, after passing through said eye of said needle, gripping said needle thread and pulling a loop of said needle thread back through said eye of said needle.

3. The automatic thread take-up and threading apparatus for a sewing machine of claim 2 wherein:

a) said gripping means comprises a projection forming a notch for receiving said needle thread; and, b) said thread take-up means includes means for releasing a gripped free end of said needle thread whereby said needle thread comes out of said notch with said needle thread threaded through said eye of said needle.

4. The automatic thread take-up and threading apparatus for a sewing machine of claim 1 and additionally comprising:

a) said signal generating means including a start switch and a threading switch; and, b) said thread take-up and threading control means including electronic control circuit means for controlling said threading means and said thread take-up means in combination in said pre-established timing relationship wherein said start switch and said threading switch are connected at an input side of said electronic control circuit and a sewing machine motor and a pulse motor are connected at an output side of said electronic control circuit via a sewing machine motor driver and a pulse motor driver;

c) a NP1 sensor connected to said input side of said electronic control circuit, said NP1 sensor being positioned to send out a detection signal when said needle bar is at a highest position, "NP1";

d) a NP2 sensor connected to said input side of said electronic control circuit, said NP2 sensor being positioned to send out a detection signal when a thread take-up portion of said thread take-up means is at a highest position, "NP2";

e) a presser-foot upper position sensor connected to said input side of said electronic control circuit and being positioned to send out a detection signal when a presser foot of the sewing machine is raised causing a tension member holding said needle thread on a supply side to open; and, f) a threading confirmation sensor connected to said input side of said electronic control circuit and being positioned to send out a detection signal when an upper end of a threading member shaft projects beyond a predetermined position.

5. The automatic thread take-up and threading apparatus for a sewing machine of claim 4 wherein said electronic control circuit means includes logic for performing the steps of:

a) initializing the sewing machine and motors thereof including setting the pulse motor to "0", when the sewing machine is first turned on by means of said start switch;

b) first determining if said start switch has been released and said presser foot is raised and the tension member is open when said threading switch is pressed by an operator to begin a fully automatic threading operation, and only proceeding to the next step when the condition is satisfied;

c) applying power to said sewing machine motor to cause said needle thread to be taken up by a thread take-up;

d) determining that an arm shaft has rotated once or more such that said NP1 condition is achieved;

e) stopping said sewing machine motor if a NP1 signal is received.

6. The automatic thread take-up and threading apparatus for a sewing machine of claim 5 wherein said electronic control circuit means additionally includes logic for performing the steps of:

rotating said pulse motor forward a number of pulses, C, and backwards the same number of pulses, C, after said sewing machine motor has been stopped in response to a detection signal from said NP1 sensor, whereby said needle thread is threaded through said eye of said needle.

7. The automatic thread take-up and threading apparatus for a sewing machine of claim 6 and additionally comprising:

a) a threading member shaft mounted for lowering and raising and for rotation in a lowered position by said pulse motor;

b) a threading hook carried by said threading member and positioned adjacent said eye of said needle when said threading member is in said lowered position;

c) linkage means for lowering said threading member shaft when said pulse motor rotates forward and rotating said threading member shaft after said threading hook is just beside said eye, whereby, c1) a thread positioning member is stretched out and first and second thread tension parts thereof are positioned to an outside point of said needle and said needle thread is pulled from an upstream side and is strung across in front of said eye of said needle as a result of a free end of said needle thread being pinched and held by a thread end keeping member, c2) said needle thread is led to an under side of a first thread tension member and positioned near said eye of said needle whereby, C3) when said threading member is rotated in a first direction a thread hook passes through said eye and catch said needle thread behind a projection thereof and when, C4) said threading member is rotated in a second direction opposite said first direction, said threading hook is withdrawn from said eye of said needle and pulls a loop of said needle thread through said eye of said needle, and C5) a free end of said needle thread is released.

8. In a sewing machine having a sewing head carrying a needle bar vertically driven by sewing motor and having a sewing needle with an eye therethrough vertically mounted on a bottom end for vertical motion therewith, automatic thread take-up and threading apparatus comprising:

a) needle thread guide means for guiding a needle thread from a needle thread supply source to a threading preparatory position in the vicinity of the needle bar via a thread take-up preparatory position intersecting a thread take-up moving area;

b) thread take-up means for extracting said needle thread at said thread take-up preparatory position along said thread take-up moving area, said thread take-up means including a thread take-up member for taking up a separate loop of needle thread;

c) threading means for pulling a loop of the needle thread at said threading preparatory position through the eye of the needle;

d) signal generating means provided in association with the sewing machine for generating signals when operated by a human operator; and, e) thread take-up and threading control means for controlling said threading means and said thread take-up means in combination in a pre-established timing relationship in response to signals from said signal generating means whereby said threading means pulls a loop of the needle thread through the eye of the needle and said thread take-up member takes up said separate loop of needle thread, said thread take-up and threading control means including prohibiting means for prohibiting a threading operation until a thread take-up operation is completed.

9. The automatic thread take-up and threading apparatus for a swing machine of claim 8 wherein said threading means comprises:

a) a pair of spaced positioning members disposed on opposite sides of the needle adjacent the eye, each of said positioning members having a guide slot means in a free end thereof positioned for receiving the needle thread and for guiding it across the eye of the needle; and, b) a thread gripping member disposed between said pair of spaced positioning members and having a free end sized and positioned to pass through the eye of the needle, said thread gripping member including releasable gripping means for, after passing through the eye of the needle, gripping the needle thread and pulling a loop of the needle thread back through the eye of the needle.

10. The automatic thread take-up and threading apparatus for a sewing machine of claim 9 wherein:

a) said gripping means comprises a projection forming a notch for receiving the needle thread; and b) said thread take-up means includes means for releasing a gripped free end of the needle thread whereby the needle thread comes out of said notch with the needle thread threaded through the eye of the needle.

11. The automatic thread take-up and threading apparatus for a sewing machine of claim 8 and additionally comprising:

a) said signal generating means including a start switch and a threading switch; and, b) said thread take-up and threading control means including electronic control circuit means for controlling said threading means and said thread take-up means in combination in said pre-established timing relationship wherein said start switch and said threading switch are connected at an input side of said electronic control circuit and a sewing machine motor and a pulse motor are connected at an output side of said electronic control circuit via a sewing machine motor driver and a pulse motor driver;

c) a NP1 sensor connected to said input side of said electronic control circuit, said NP1 sensor being positioned to send out a detection signal when the needle bar is at a highest position, "NP1";

d) a NP2 sensor connected to said input side of said electronic control circuit, said NP2 sensor being positioned to send out a detection signal when a thread take-up portion of said thread take-up means is at a highest position, "NP2";

e) a presser-foot upper position sensor connected to said input side of said electronic control circuit and being positioned to send out a detection signal when a presser foot of the sewing machine is raised causing a tension member holding the needle thread on a supply side to open; and, f) a threading confirmation sensor connected to said input side of said electronic control circuit and being positioned to send out a detection signal when an upper end of a threading member shaft projects beyond a predetermined position.

12. The automatic thread take-up and threading apparatus for a sewing machine of claim 11 wherein said electronic control circuit means includes logic for performing the steps of:

a) initializing the sewing machine and motors thereof including setting the pulse motor to "0", when the sewing machine is first turned on by means of said start switch;

b) first determining if said start switch has been released and said presser foot is raised and the tension member is open when said threading switch is pressed by an operator to begin a fully automatic threading operation, and only proceeding to the next step when the condition is satisfied;

c) applying power to said sewing machine motor to cause the needle thread to be taken up by a thread take-up;

d) determining that an arm shaft has rotated once or more such that said NP1 condition is achieved;

e) stopping said sewing machine motor if a NP1 signal is received.

13. The automatic thread take-up and threading apparatus for a sewing machine of claim 12 wherein said electronic control circuit means additionally includes logic for performing the steps of:

rotating said pulse motor forward a number of pulses, C, and backwards the same number of pulses, C, after said sewing machine motor has been stopped in response to a detection signal from said NP1 sensor, whereby the needle thread is threaded through the eye of the needle.

14. The automatic thread take-up and threading apparatus for a sewing machine of claim 13 and additionally comprising:

a) a threading member shaft mounted for lowering and raising and for rotation in a lowered position by said pulse motor;

b) a threading hook carried by said threading member and positioned adjacent the eye of the needle when said threading member is in said lowered position;

c) linkage means connected for when said pulse motor rotates forward, lowering said threading member shaft and after said threading hook is just beside the eye rotating said threading member shaft whereby, C1) a thread positioning member is stretched out and first and second thread tension parts thereof are positioned to an outside point of the needle and the needle thread is pulled from an upstream side and is strung across in front of the eye of the needle as a result of a free end of the needle thread being pinched and held by a thread end keeping member, c2) the needle thread is led to an under side of a first thread tension member and positioned near the eye of the needle, c3) said threading member is rotated in a first direction causing a threading hook to pass through the eye and catch the needle thread behind a projection thereof, c4) said threading member is rotated in a second direction opposite said first direction causing said threading hook to e withdrawn from the eye of the needle and pull a loop of the needle thread through the eye of the needle, and c5) a free end of the needle thread is released.

15. In a sewing machine having a sewing head carrying a needle bar vertically driven by a sewing motor and having a sewing needle with an eye therethrough vertically mounted on a bottom end for vertical motion therewith, automatic thread take-up and threading apparatus comprising:

a) needle thread guide means for guiding a needle thread from a needle thread supply source to a threading position adjacent the eye of the needle;

b) first gripping means for gripping free end of the needle thread adjacent said threading position;

c) threading means for reaching through the eye and for pulling a loop of the needle thread through the eye of the needle;

d) grip release means for releasing said free end from said first gripping means;

e) thread take-up means for catching and taking up a separate loop of the needle thread between said supply source and the eye of the needle;

f) signal generating means provided in a association with the sewing machine for generating signals when operated by a human operator; and, g) thread take-up and threading control means for controlling said threading means and said thread take-up means in combination in a pre-established timing relationship in response to signals from said signal generating means whereby aid threading means pulls a loop of the needle thread through the eye of the needle and said thread take-up member takes up said separate loop of needle thread, said thread take-up and threading control means including prohibiting means for prohibiting a threading operation until a thread take-up operation is completed.

16. The automatic thread take-up and threading apparatus for a sewing machine of claim 15 wherein said threading means comprises:

a) a pair of spaced positioning members disposed on opposite sides of the needle adjacent the eye, each of said positioning members having a guide slot means in a free end thereof positioned for receiving the needle thread and for guiding it across the eye of the needle; and, b) a thread gripping member disposed between said pair of spaced positioning members and having a free end sized and positioned to pass through the eye of the needle, said thread gripping member including releasable gripping means for, after passing through the eye of the needle, gripping the needle thread and pulling a loop of the needle thread back through the eye of the needle.

17. The automatic thread take-up and threading apparatus for a sewing machine of claim 16 wherein:

said gripping means comprises a projection forming a notch for receiving the needle thread.

* * * * *